US010696443B1

(12) United States Patent
Mundt et al.

(10) Patent No.: US 10,696,443 B1
(45) Date of Patent: Jun. 30, 2020

(54) PACKAGING WITH SLIDING TRAY LOCK

(71) Applicant: Apple Inc., Cupertino, CA (US)

(72) Inventors: Matthew Mundt, Pewaukee, WI (US); Connie Yang, Portola Valley, CA (US); Jonathan M. McCarren, San Francisco, CA (US); Bhautik H. Mehta, Mountain View, CA (US); Evan M. Rosebrock, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/697,871

(22) Filed: Sep. 7, 2017

Related U.S. Application Data

(60) Provisional application No. 62/465,590, filed on Mar. 1, 2017.

(51) Int. Cl.

| | |
|---|---|
| ***B65D 5/38*** | (2006.01) |
| ***B65D 43/12*** | (2006.01) |
| *B65D 51/18* | (2006.01) |
| *B65D 81/18* | (2006.01) |

(52) U.S. Cl.
CPC ..... *B65D 5/38* (2013.01); *B65D 43/12* (2013.01); *B65D 51/18* (2013.01); *B65D 81/18* (2013.01)

(58) Field of Classification Search
CPC ..... B65D 5/38; B65D 5/728; B65D 55/028; B65D 55/02; B65D 2583/0468; B65D 11/12; B65D 43/20; B65D 43/12
USPC ..... 206/758; 229/125.125, 125.25, 125.19, 229/125.26, 129.1, 220, 125.07, 125.32; 220/345.2, 345.4, 345.5
See application file for complete search history.

(56) References Cited

U.S. PATENT DOCUMENTS

| | | | | |
|---|---|---|---|---|
| 533,044 A * | 1/1895 | Bingham | ..... | B65D 5/38 229/125.125 |
| 2,295,747 A * | 9/1942 | Mills | ..... | B65D 43/12 220/351 |
| 2,309,111 A * | 1/1943 | Hothersall | ..... | B65D 43/20 206/534.1 |

(Continued)

FOREIGN PATENT DOCUMENTS

| | | | | |
|---|---|---|---|---|
| CH | 525126 A * | 7/1972 | ..... | B65D 43/12 |
| DE | 2706065 A1 * | 8/1978 | ..... | A47K 1/09 |

(Continued)

OTHER PUBLICATIONS

WO_2009038219_translation.pdf.*
CH_525126_translation.pdf.*

*Primary Examiner* — Allan D Stevens
(74) *Attorney, Agent, or Firm* — Sterne, Kessler, Goldstein & Fox P.L.L.C.

(57) ABSTRACT

A package may include a sled configured to receive a product, and a sleeve configured to receive the sled through a first or second opening. The sleeve may include a top wall, a bottom wall, and first and second sidewalls, defining the first and second openings. The sleeve may include a rib extending downward from the top wall and positioned substantially parallel to an edge of the top wall proximate the first opening. The rib may engage the sled when the package is in a closed position, and in response to a force sliding the sleeve relative to the sled, the rib may deflect and produce an indication of opening or closing.

12 Claims, 11 Drawing Sheets

(56) References Cited

U.S. PATENT DOCUMENTS

| | | | | | |
|---|---|---|---|---|---|
| 2,378,003 | A * | 6/1945 | Duell | B65D 43/20 | 206/538 |
| 2,410,923 | A * | 11/1946 | Beardsley | B65D 5/728 | 229/125.125 |
| 2,777,570 | A * | 1/1957 | Mytinger | A61J 1/03 | 206/539 |
| 3,033,355 | A * | 5/1962 | Van Sickle | B65D 43/12 | 206/539 |
| 3,082,902 | A * | 3/1963 | Kimbrough, Jr. | B65D 43/12 | 206/465 |
| 3,362,564 | A * | 1/1968 | Mueller | B65D 43/20 | 220/345.3 |
| 3,765,595 | A * | 10/1973 | Bernhardt | B65D 77/2056 | 206/515 |
| 3,782,584 | A * | 1/1974 | Swenson | B65D 43/12 | 206/232 |
| 5,299,711 | A * | 4/1994 | Romick | B65D 43/12 | 206/534 |
| 5,356,011 | A * | 10/1994 | Romick | A61J 1/03 | 206/534 |
| 8,011,512 | B2 * | 9/2011 | Brollier | A61J 1/035 | 206/1.5 |
| 2004/0217116 | A1 * | 11/2004 | Offerman | B65D 43/12 | 220/345.2 |

FOREIGN PATENT DOCUMENTS

| | | | | |
|---|---|---|---|---|
| FR | 1028232 A | * | 5/1953 | B65D 43/20 |
| GB | 456176 A | * | 11/1936 | B65D 43/20 |
| GB | 457854 A | * | 12/1936 | B65D 43/20 |
| GB | 457855 A | * | 12/1936 | B65D 43/20 |
| WO | WO 2009038219 A1 | * | 3/2009 | B65D 5/38 |

* cited by examiner

PACKAGING WITH SLIDING TRAY LOCK

CROSS-REFERENCE TO RELATED APPLICATIONS

This application claims benefit under 35 U.S.C. § 119(e) of U.S. Provisional Patent Application No. 62/465,590, filed Mar. 1, 2017, titled "Packaging with Sliding Tray Lock," which is incorporated herein in its entirety by reference thereto.

FIELD

The described embodiments relate generally to retail packaging systems and methods. More particularly, the present embodiments relate to retail packaging for consumer products that may be opened by a customer before purchase in a retail environment.

SUMMARY

Some embodiments are directed to packaging, which may include a sled configured to receive a product, and a sleeve configured to receive the sled through a first or second opening. In some embodiments, the sleeve may include a top wall, a bottom wall, and first and second sidewalls, and the openings may be generally rectangular. The top, bottom, and sidewalls may define the first and second openings.

In some embodiments, the sleeve may include a rib extending downward from the top wall and positioned substantially parallel to an edge of the top wall proximate the first opening. The rib may engage the sled when the packaging is in a closed position, and in response to a force sliding the sleeve relative to the sled, the rib may deflect and produces audible/tactile indication of opening or closing, e.g., sealing or unsealing. There may be a space between the rib and sled when the packaging is in a closed position. The rib may include a lower fillet, which may provide a curved surface between the wall and a portion of the rib that extends from the top surface. The rib may include an upper fillet, which may provide a curved surface at an upper edge of the rib.

The sleeve may include a second rib formed similar to the first. The first and second ribs may be spaced equidistantly from the edge of the first and second openings, respectively. The ribs may be spaced from an edge of the top wall proximate the respective opening. The rib may be spaced from one or more of the sidewalls of the sleeve, such that tracks may be formed between the rib and the sidewalls of the sleeve so that upper edges of the sled sidewalls may slide along the track.

In some embodiments, one or both of the sled or sleeve is constructed entirely from paper, e.g., a sheet of paper substrate, like cardboard or paperboard. For example, the sleeve may be integrally formed from a continuous substrate. The top wall and rib may be formed from a continuous substrate such that the rib extends away from the top wall and is folded back onto itself towards the top wall. In this respect, the thickness of the rib may be twice the thickness of the substrate.

In some embodiments, the sled includes a bottom surface for receiving a product. The sled may include first and second sidewalls corresponding to the first and second opening of the sleeve. In some embodiments, the first sidewall is configured to engage the rib when the packaging is in a closed position. In some embodiments, the sidewall may engage the sled when the packaging moves to a closed position. The sled may include third and fourth sidewalls, for example, perpendicular to the first and second sidewalls. In some embodiments, the sled is substantially rigid. In some embodiments, the sled includes a hang tab such that a user may pull the sled from the sleeve from a closed position to an open position.

In some embodiments, the sleeve may be five-sided, having a single opening. In some embodiments, the rib may be formed proximate a sidewall opposite the single opening. In some embodiments, additional ribs may be formed in line with each other, along substantially the same direction, e.g., proximate the sidewall opposite the single opening.

The sleeve may be formed from a single sheet, e.g., a blank. In some embodiments, the blank is folded such that the tabs, flaps, and regions without adhesive are folded such that no adhesive is visible in a finished sleeve configuration. Additionally or alternatively, adhesive may be omitted from some or all of the regions, and the various flaps and tabs attached in another suitable manner. An interior edge of the blank may lead to a rib region, which when folded inward towards the top surface creates the rib. In some embodiments, the interior edge may extend towards the center of the top wall, such that when folded over there is no raw edge on the outside of sleeve. Additional panels may be folded onto each other to eliminate raw edges on various surfaces of the sleeve or the sled. Individual blank sections may be folded onto one another, for example to create the top wall, and bottom wall.

Ribs may be formed, for example, using a variety of techniques, such as folding/pre-folding, creasing, scoring, v-mitering, k-cutting, perforating, cutting, or a combination thereof. In some embodiments, along an individual rib, a plurality of these techniques may be used in a pattern, such as folding and k-cutting. In this way, assembly and manufacturing may be improved.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
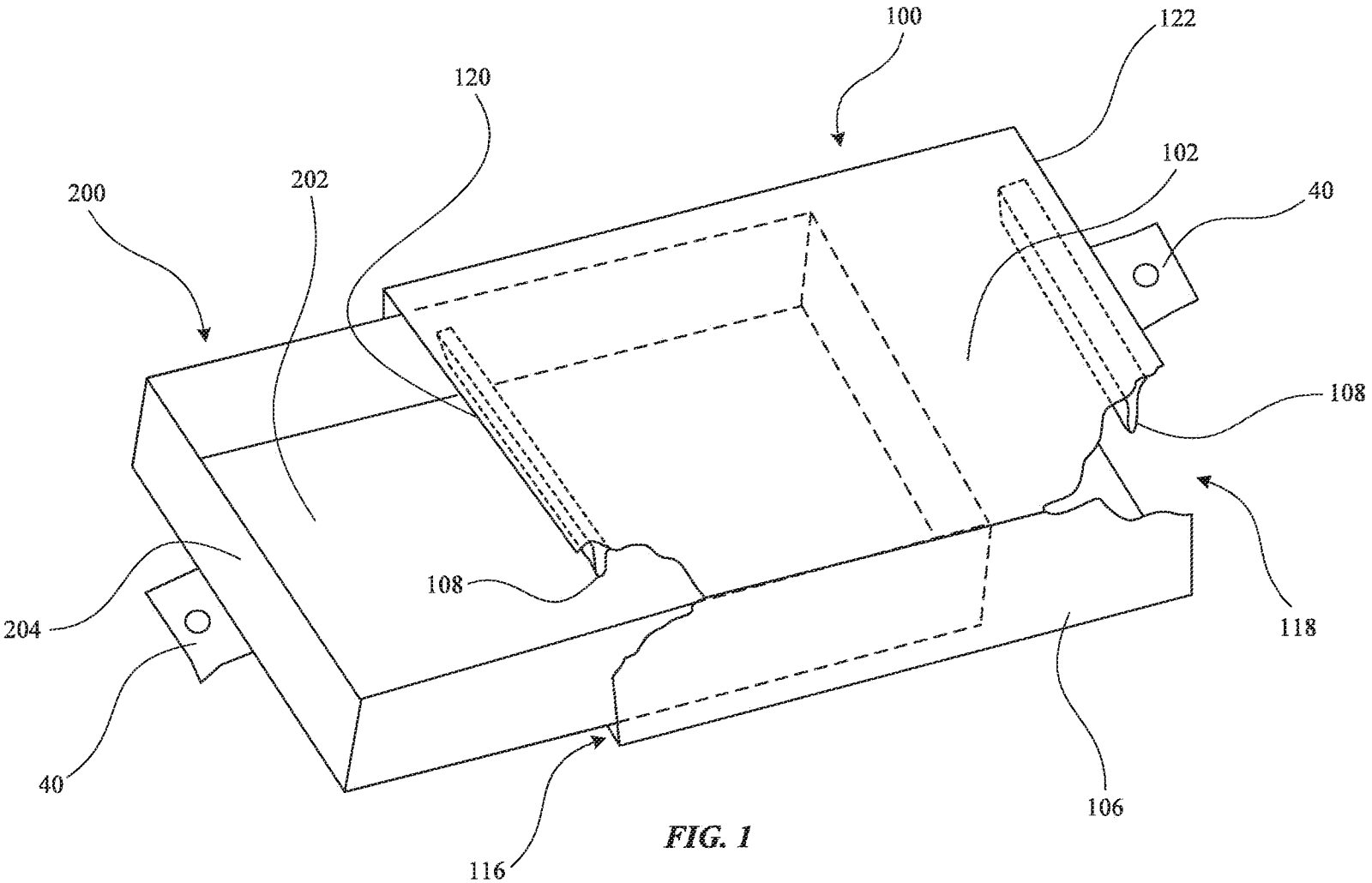
FIG. 1 shows a perspective view of packaging.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Packaging for consumer products may be an important marketing tool used to attract and retain customers. Packaging should be aesthetically appealing, but at the same time direct a customer's attention to the product it is designed to hold. Packaging having defects or imperfections can draw the customer's attention away from the product it is holding or make the product seem less appealing. Optimization of packaging may promote a positive user experience. Environmental considerations may play a role in designing packaging. For example, packaging may be designed to be environmentally friendly. Packaging made out of recyclable and/or biodegradable materials, such as paper or paper-based products can reduce environmental impact.

The packaging described herein may be used to hold and ship items, such as, for example, consumer products such as cases for electronic devices such as laptops, phones, multimedia devices, tablets, gaming devices, keyboards, headsets, earphones, cameras, mice, trackpads, remotes, and watches.

Packaging containing defects may attract negative attention to the packaging and may give the customer a negative impression of the product and or the product's brand. On the other hand, packaging that is flawless in character may boost a product's or a brand's reputation, thereby attracting new customers and retaining previous customers. For packaging in a retail setting, such as a store, if packaging is damaged by a customer opening the packaging to inspect a product, this may adversely affect the impression of the product if the customer then re-shelves the product in the damaged packaging. In contrast, packaging that encourages a customer to interact with and experience the product prior to purchase, while resisting damage and being able to withstand multiple open and close cycles is advantageous in a retail setting.

Some embodiments of the present invention include packaging that is readily openable in a store by a user seeking to inspect a product before purchase. For example, the packaging may include a tray that holds the product that can slide out of and in to a sleeve to open and close the packaging. To keep the product secure, the sleeve may include a pair of ribs protruding from its interior, to engage sides of the tray. The ribs extend down lower than the upper sides of the tray, so that they can hold the tray in place when the packaging is closed. For example, the ribs may contact or be close to the interior sides of sidewalls of the tray. When a customer pushes the tray relative to the sleeve, one of the ribs may deflect over the tray wall, releasing the tray and allowing the customer to freely slide the tray out to view the product without causing any damage to the packaging. When the customer is done, they can simply slide the tray back into the sleeve, and will feel and hear a pop or click as the rib deflects back within the tray to secure the package.

These and other embodiments are discussed below with reference to the figures. However, those skilled in the art will readily appreciate that the detailed description given herein with respect to these figures is for explanatory purposes only and should not be construed as limiting.

Exemplary packaging 10 is shown in FIG. 1. Packaging 10 may include a sleeve 100 and a sled 200, for together packaging product 300. Sleeve 100 and sled 200 may slide together, for example with sled 200 sliding within sleeve 100. For example, a customer may slide sled 200 out of sleeve 100 to inspect product 300 without damaging packaging 10. This is in contrast to packaging having adhesive, tape, etc., that inhibit their opening and that may result in changed or damaged packaging upon overcoming the inhibition and opening the packaging. In some embodiments, sleeve 100 or sled 200 may include one or more hang tabs 40 that a user may pull to pull sled 200 from the sleeve 100 to open packaging 10.

Figure 2:
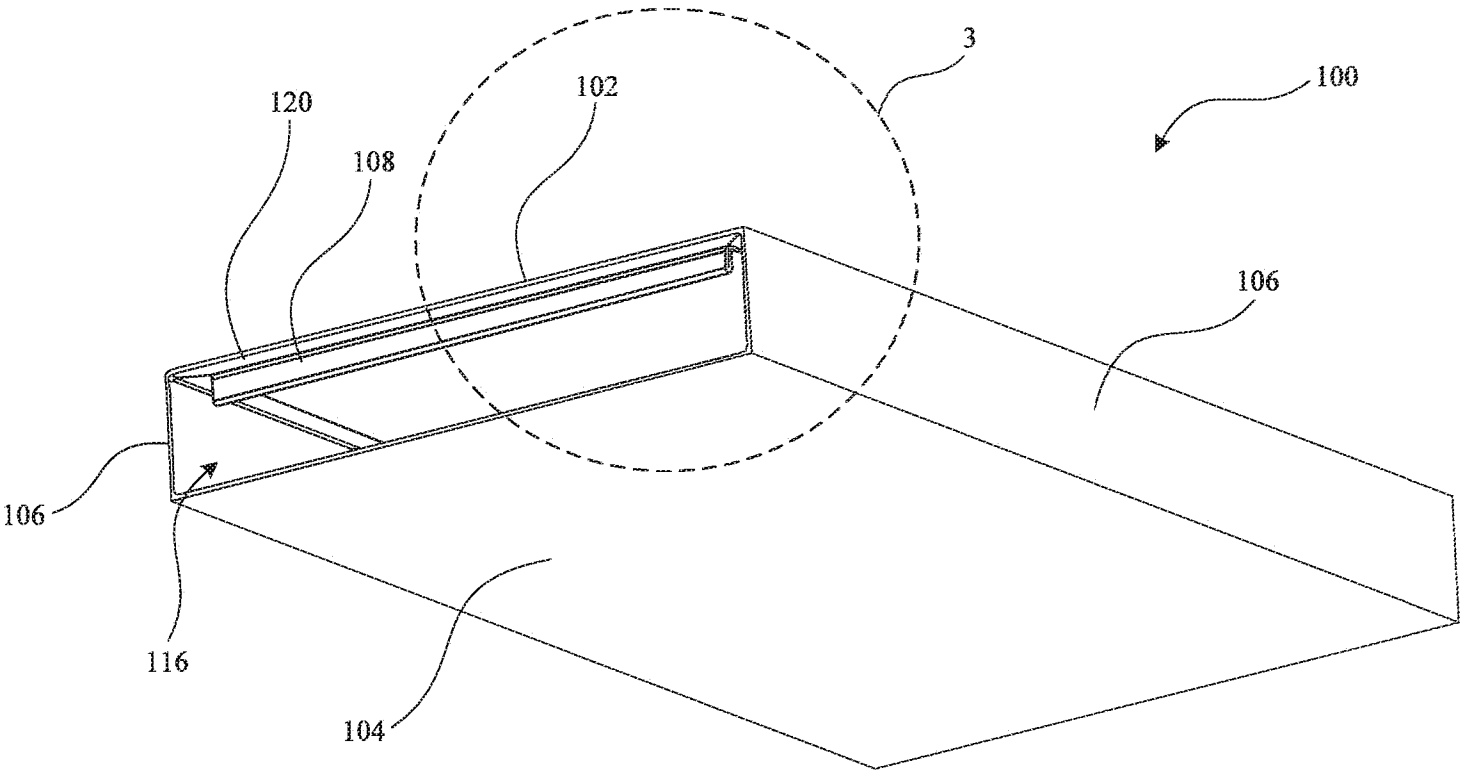
FIG. 2 shows a bottom perspective view of packaging.
Figure 3:
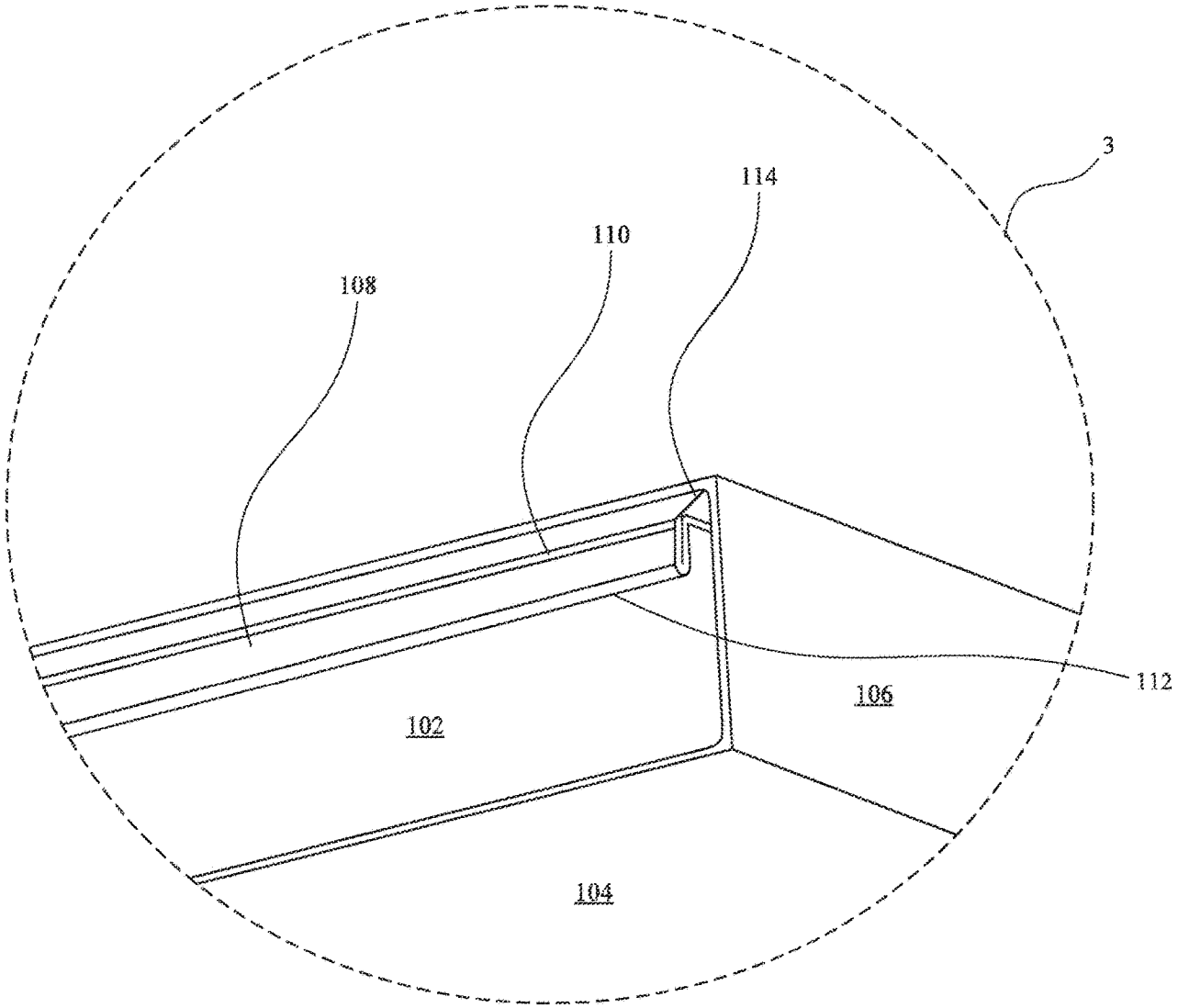
FIG. 3 shows a magnified bottom perspective view of the packaging shown in FIG. 3.

To help maintain packaging 10 in an open or closed position, in response to a force sliding sleeve 100 relative to the sled 200, a rib 108 of sleeve 100 is deflected and produces a tactile and audible indication of opening or closing. As shown in FIGS. 2 and 3 for example, sleeve 100 includes a top wall 102, a bottom wall 104, and sidewalls 106. Sleeve 100 also includes one or more ribs 108. Each rib 108 may include a lower fillet 110 and an upper fillet 112. Lower fillet 110 and upper fillet 112 may allow for easier travel of the sled 200 to deflect rib 108. Alternatively, in some embodiments rib 108 may omit upper or lower fillets, or include chamfers, for example.

In use, sleeve 100 may receive sled 200 through a first opening 116 or second opening 118, for example by sliding sled 200 into and out of sleeve 100. As shown in FIG. 2, top wall 102, bottom wall 104, and sidewalls 106 define the first and second openings 116/118 of the sleeve 100. In some embodiments, the openings may be rectangular openings, which are connected through a rectangular channel through the sleeve 100.

As shown, rib 108 extends downward from top wall 102, parallel to an edge of top wall 102, for example, proximate the first opening 116, e.g., closer to first opening 116 than second opening 118. For example, the distance from rib 108 to the edge of the first opening 116 may be equal to the thickness of sidewalls 204 of sled 200, such that when closed sidewalls 204 of sled 200 are maintained flush with opening 116. The openings may be open at all times, that is, not include a closure flap. In some embodiments, removable flaps may cover the openings, such that they may be folded out of the way to remove sled 200 from sleeve 100.

In some embodiments, rib 108 is configured to contact, or engage, sled 200 when packaging 10 moves between open and closed positions.

Ribs 108 may be positioned such that they do not contact product 300 when product 300 is within packaging system 10 (e.g., disposed on an interior surface 202). In some embodiments, rib 108 may alternatively extend from a different wall of sleeve 100. Each rib 108 may be coated with a protective coating, which may help maintain the integrity of product 300 if it contacts rib 108.

Sleeve 100 may include a second rib 108 extending downward from top wall 102. Second rib 108 may be positioned parallel to an edge of top wall 102 proximate the second opening 118, for example at the opposite end of sleeve 100 from the first rib 108 and closer to second opening 118 than first opening 116. One or both of ribs 108 may be spaced from sidewalls 204 of sled 200 when the packaging 10 is in a closed position, to allow some relative motion between tray 200 and sleeve 100, which may avoid sidewalls 204 putting constant pressure against ribs 108. Alternatively, in some embodiments, first rib 108 and second rib 108 are configured to contact, or engage, opposite end walls of sled 200 to hold it in position relative to sleeve 100 when the packaging 10 is closed. In other words, the spacing between the exterior-facing sides of ribs 108 may be equal to or greater than the spacing between interior-facing sides of sidewalls 204 of sled 200.

In some embodiments, first and second ribs 108 are spaced equidistantly from the edges 120/122 of the first and second openings 116/118, respectively. In some embodiments, the first and second ribs 108 may be spaced at different distances from the edge 120 of the first opening 116 and edge 122 of the second opening 118, respectively to accommodate different sled 200 dimensions. In some embodiments, first and second ribs 108 may extend the same distance from top wall 102, or may extend different distances, for example to produce a difference in feedback if packaging 10 is opened in one direction or the other. In some embodiments, second rib 108 may be spaced from the first rib along the same edge, e.g., disposed in a side-by-side relationship with a space between them, both extending in the same direction along the same line. In this way, the ribs may be separate structures, but engage sled 200 at the same time along an opening or closing cycle.

In some embodiments, rib 108 may be offset from one or more of sidewalls 106. In this regard, sled walls 206/208 (shown in FIG. 4, for example) can slide within sleeve 100 since once front and rear sidewalls 204 are past rib 108, rib 108 will not impede travel of side sidewalls 106.

In some embodiments, one or both of sled 200 and sleeve 100 is constructed entirely from paper. In some embodiments, sleeve 100 is integrally formed from a continuous substrate. For example, top wall 102 and rib 108 may be formed from a continuous sheet of paper-based substrate such that rib 108 extends away from top wall 102 and is folded back onto itself towards top wall 102 (see, e.g., FIGS. 3, and 6-8). In this regard, a thickness of rib 108 may be twice the thickness of the substrate that forms the portion of top wall 102.

In some embodiments, top wall 102 may be composed of multiple panels, as described below in more detail with reference to FIG. 9. In this regard, interior edge 114 is shown, for example in FIG. 3, such that the surface forming top wall 102 and rib 108 extends inward from the opening, and interior edge 114 exists through rib 108 and continues on parallel to the openings of sleeve 100. In some embodiments, there may be adhesive between the surfaces of rib 108 that are folded back on themselves, for example to alter the rigidity or feedback of rib 108 (e.g., including adhesives may make rib 108 more rigid and harder to deflect, and different adhesives may contribute to rigidity to different degrees. In some embodiments, no adhesive is included on these surfaces. In some embodiments, there may be a space between the surfaces of rib 108 that fold back on themselves. In some embodiments, there is no space between the surfaces of rib 108 that fold back on themselves, for example to alter the rigidity or feedback given when packaging 10 is opened.

Figure 4:
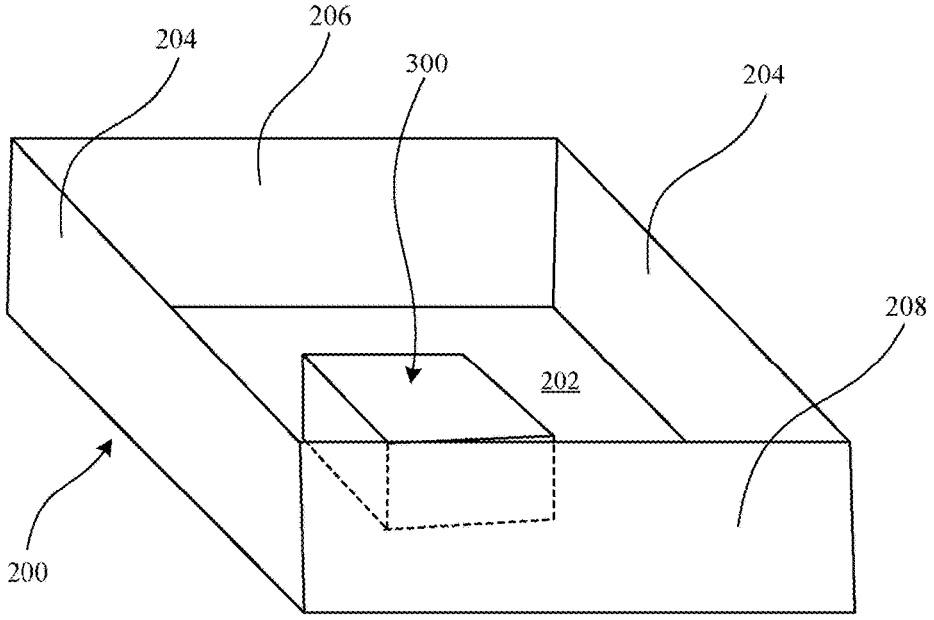
FIG. 4 shows a sled and a product positioned on the sled.
Figure 5:
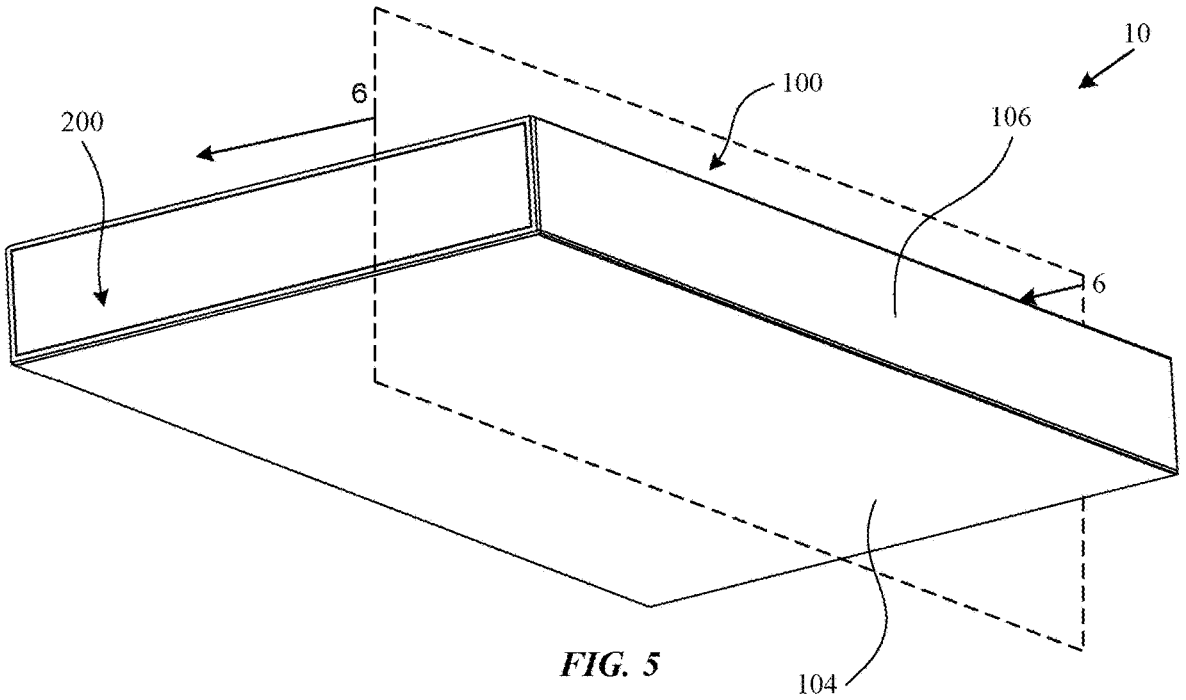
FIG. 5 shows a packaging in a closed position.

Turning to FIG. 4, in some embodiments sled 200 may include a bottom surface for holding product 300. Sled 200 may include sidewalls 204 configured as first and second sidewalls corresponding to the first 116 and second 118 opening of sleeve 100. Packaging 10 is shown closed in FIG. 5, showing sidewall 204 occupying first opening 116 of sleeve 100 when sled 200 is inserted into sleeve 100. Sidewalls 204 engage ribs 108 when packaging 10 is moved from a closed position to an open position, thereby keeping packaging 10 closed until a customer applies enough force to deflect sled 200 past rib 108 as will be described in greater detail below.

Sled 200 may include sled walls 206/208 configured as third and fourth sidewalls and disposed perpendicular to sidewalls 204 configured as first and second sidewalls, e.g., to form an open box. Alternatively, sled walls 206/208 may be omitted, such that an open tray is formed, and which may optimize the force required to opening packaging 10. In some embodiments, sled 200 may have an additional element configured to engage the ribs 108, such as a detent, aperture, protrusion, etc., in order to optimize the force required to opening packaging 10, or tune the feedback given when packaging 10 is opened. In some embodiments, the height of ribs 108 may be adjusted for similar reasons. In some embodiments, sled 200 is substantially rigid, i.e., when engaging rib 108, it does not deflect, or deflects to a lesser degree than rib 108.

Figure 6:
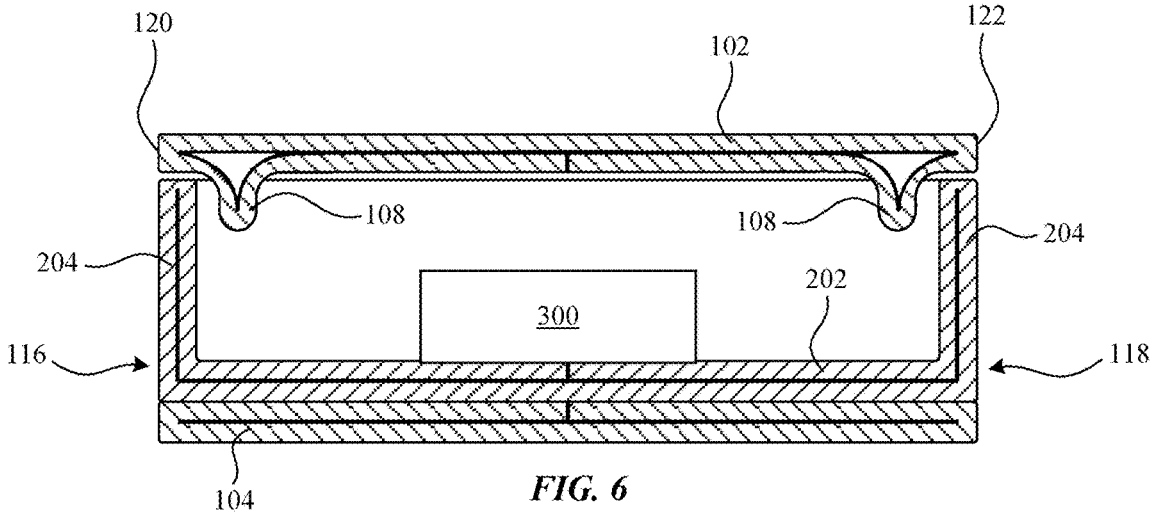
FIGS. 6-8 show cut-away view schematic illustrations of packaging in various positions.
Figure 7:
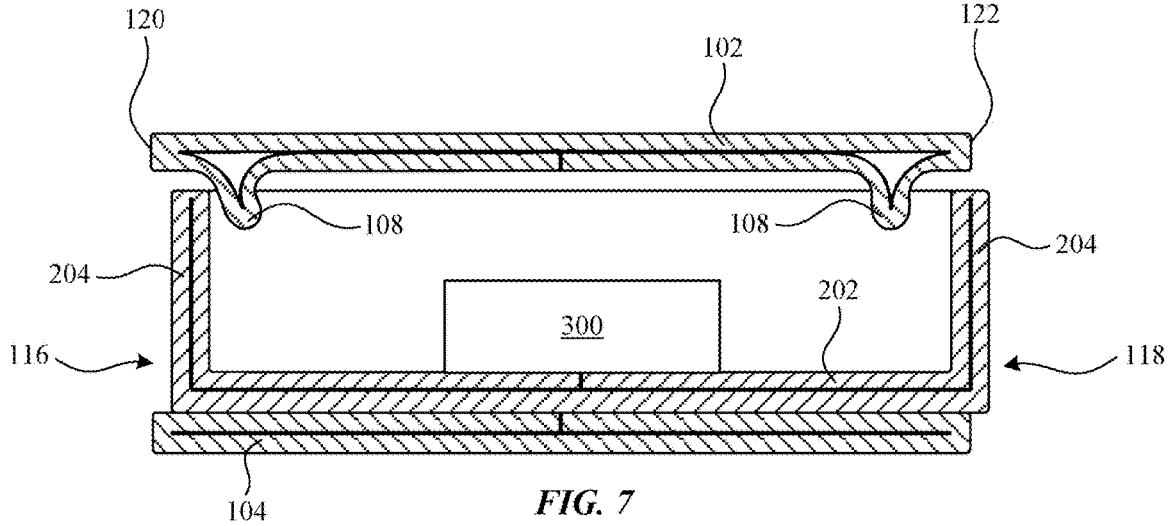
Figure 8:
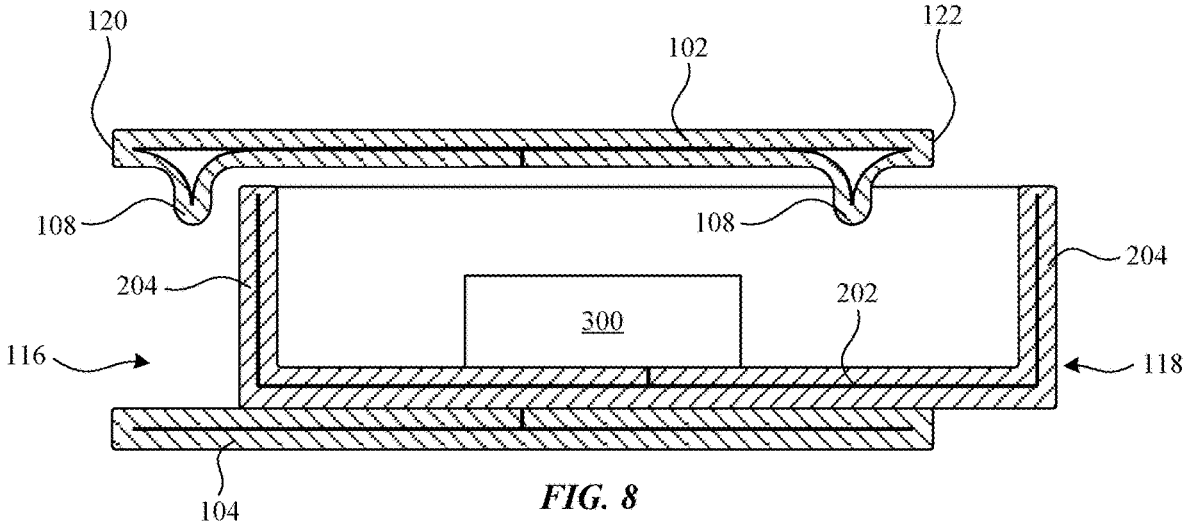

FIGS. 6-8, are cross-sectional views taken along line 6-6 of FIG. 5 showing how sleeve 100 and sled 200 interact when opening and closing packaging 10. FIG. 6 shows packaging 10 closed, FIG. 7 shows packaging 10 when opening has just been initiated and rib 108 is just starting to deflect. And FIG. 8 shows packaging 10 open.

As shown in FIG. 6, sidewalls 204 engage ribs 108 because outer surfaces of opposing ribs 108 are in contact with inner surfaces of sidewalls 204 of sled 200, thereby limiting motion of sled 200 relative to sleeve 100. Although ribs 108 are shown to be interior of sidewalls 204 when packaging 10 is closed, in some embodiments they may engage outer surfaces of sidewalls 204 to similar effect.

As shown in FIG. 7, when a force is applied against sidewall 204, sled 200 is pushed relative to sleeve 100 to open packaging system 10, causing rib 108 to deflect. In some embodiments, rib 108 may have been conditioned prior to initial assembly of packaging 10, for example in order to "break-in" the deflection action. Conditioning rib 108 may include manually folding rib 108 in one or both directions, such that the peak force required to deflect the rib 108 is decreased to a desired level. Since the most significant reduction in peak force required to deflect rib 108 occurs upon its initial deflection, after break-in rib 108 may be cycled frequently with minimal reduction in peak force required to deflect rib 108 (e.g., the optimum force lasts throughout a shelf-life of cycles (e.g., 30 to 40 cycles), such that one open/close cycle is substantially the same as subsequent cycles).

As the application of force continues, rib 108 may deflect high enough to go over sidewall 204, thereby freeing sidewall 204 to pass, as shown in FIG. 8. When rib 108 deflects over sidewall 204 is may snap back to its original position, and in doing so may produce an audible and/or tactile indication to a user applying the force, such as a haptic or auditory impulse like a snap or a pop. This feedback is an indication to the customer that the packaging is open (e.g., from closed or "locked"). Second rib 108 may also deflect and produce an audible and/or tactile indication to the customer, for example if force is continuously applied such that sled 200 becomes wholly outside sleeve 100.

In some embodiments, the force may be a pulling force applied to sled 200. In other embodiments, the force may be a pulling or pushing force on sleeve 100. In some embodiments, the force may be applied to a pull/push tab (e.g., tab 40) that is a part of sleeve 100 or sled 200. In some embodiments, the force may be a combination of complimentary pulling and/or pushing forces on both sled 200 and sleeve 100.

Figure 9:
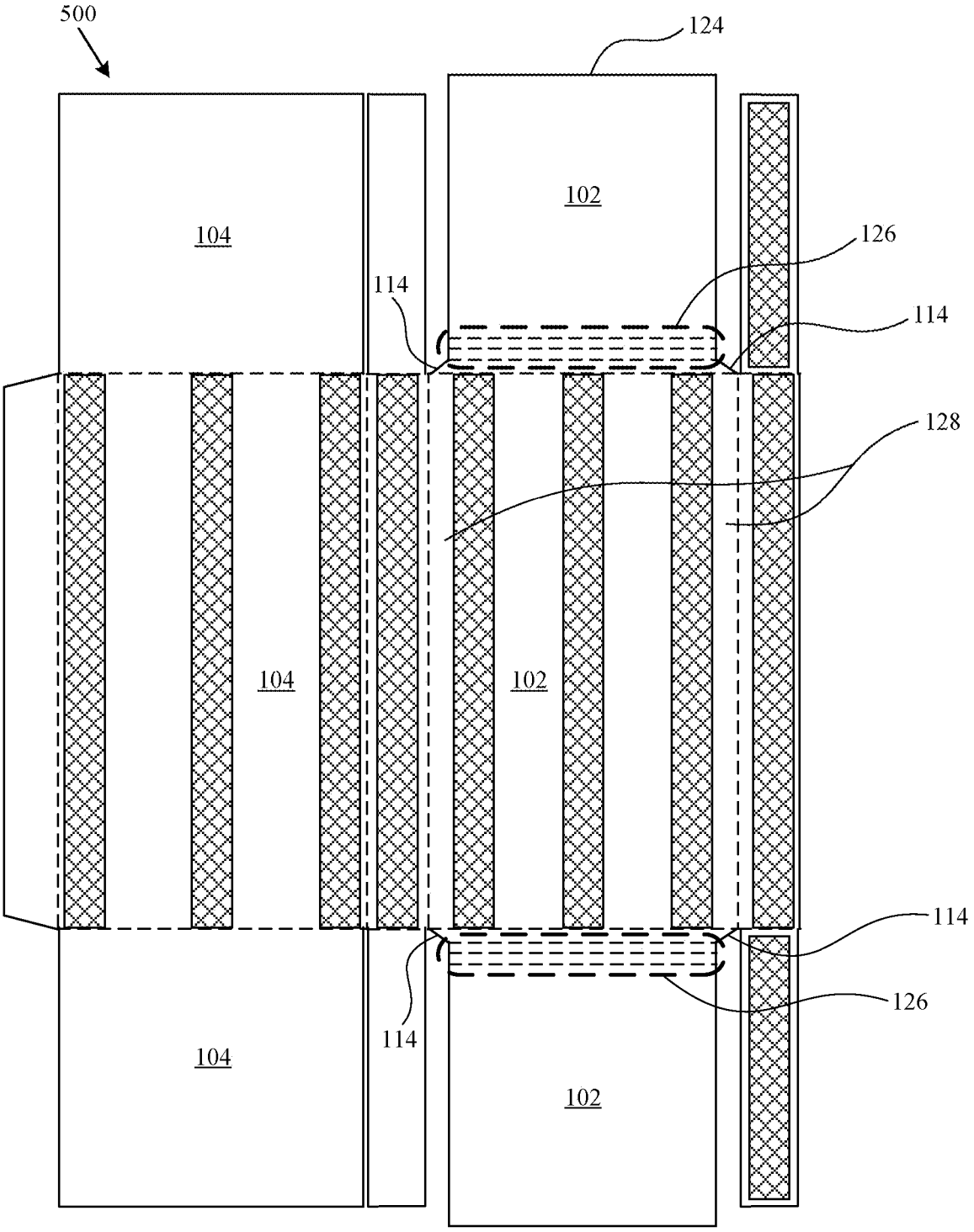
FIG. 9 shows a schematic of an exemplary sleeve blank showing fold lines and adhesive or tape surfaces.

FIG. 9 shows an exemplary schematic of a blank 500 for forming sleeve 100. Blank 500 is formed of a single continuous substrate, such as, for example a paper-based material like cardboard or paperboard. In some embodiments, interior surfaces of blank 500 may be surface treated or coated, for example with a coating to protect the finished sleeve 100, or product 300. Dotted lines indicate fold lines, and cross-hatching indicates adhesive. Tabs, flaps, and regions without adhesive of blank 500 are folded such that no adhesive is visible in finished sleeve 100. In some embodiments, adhesive may be omitted and the various flaps and tabs attached in another suitable manner. Fold lines may be formed, for example, by weakening the substrate along the lines, such as by perforation, material crushing, scoring, miter cutting, etc.

As shown, interior edge 114 when folded inward towards top wall 102 creates rib 108, as shown with reference to rib region 126. Interior edge 114 extends towards the center of top wall 102, such that when folded over and adhered together there is no raw edge on the outside of sleeve 100 (e.g., a seam formed by edges 124 is hidden centrally within sleeve 100). As discussed above, rib 108 may be offset from one or more of sidewalls 106. As shown when the upper and lower portions of top wall 102 are folded inward, a track 128 may be formed, for example to allow sled walls 206/208 slide within sleeve 100, and ribs 108 may be closed within sled 200. Additional panels may be folded onto each other to eliminate raw edges on various surfaces of sleeve 100 or sled 200. As shown in FIG. 9, individual blank sections may be folded onto one another, for example to create top wall 102 and bottom wall 104. In some embodiments, sleeve 100 may be constructed with multiple blanks.

Figure 10:
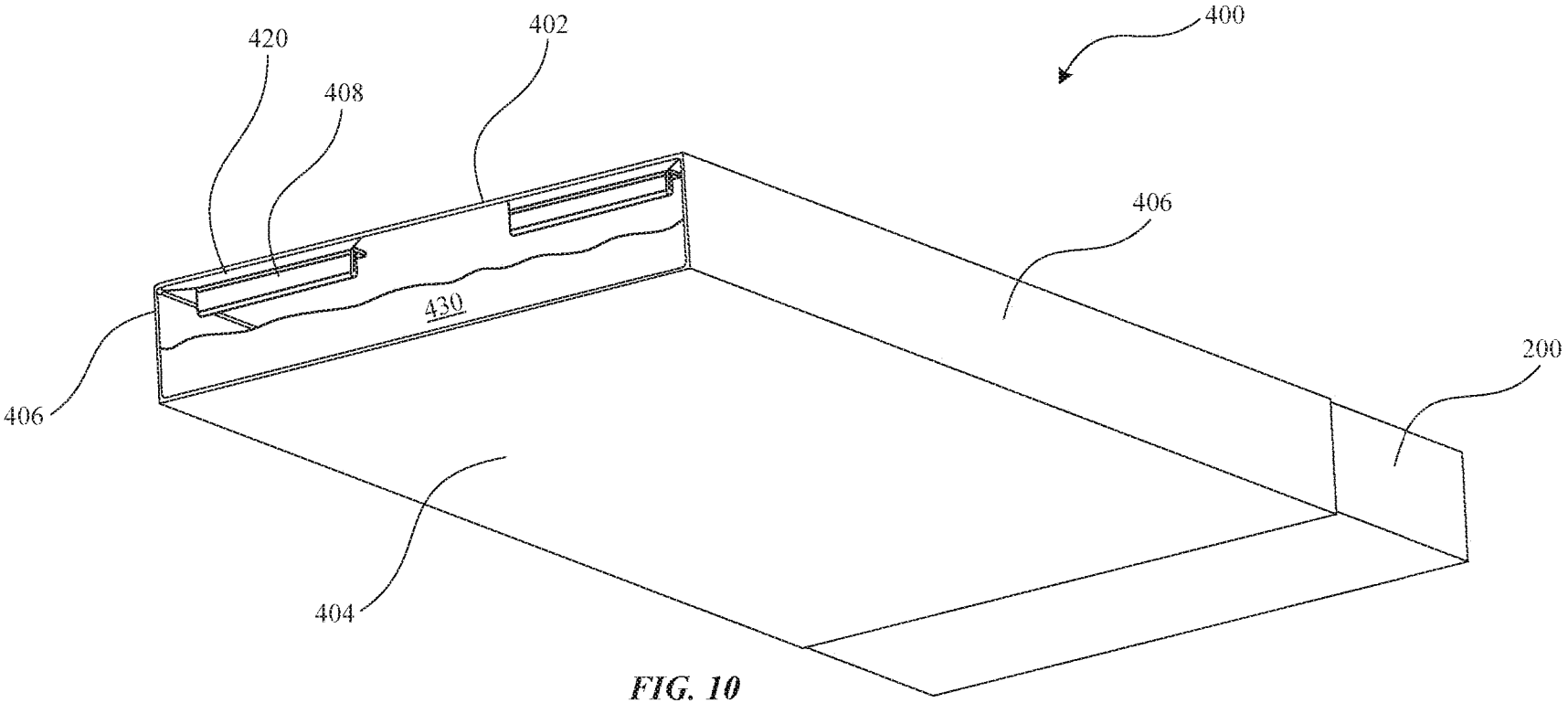
FIG. 10 shows a perspective view of an exemplary packaging.

Turning to FIG. 10, packaging sleeve 400 is shown. Features of sleeve 400 may be applied to sleeve 100, and vice versa. In general, sleeve 400 may be similarly formed as sleeve 100, including being fashioned from folded paper (e.g., cardboard or paperboard). As shown in FIG. 10, sleeve 400 may include a rear wall 430 (shown partially broken-away for illustrative purposes), making sleeve 400 five-sided. As shown, sleeve 400 may include side walls 406, top wall 402, and bottom wall 404. Sleeve 400 includes one or more ribs 408 in some embodiments. Ribs 408 may be formed similar to rib 108, as described herein. In sleeve 400, two ribs 408 may be spaced apart from one another, for example extending from top wall 402 equidistantly from rear wall 430. In some embodiments, ribs 408 may be positioned only proximate rear wall 430 (e.g., very close such that sled 200 engages sleeve 400 very close to or abutting rear wall 430), such that when a sled (e.g., sled 200) is inserted into sleeve 400, a user will not visually detect ribs 408 (e.g., through an open end of sleeve 400). As shown, ribs 408 may be folded back onto themselves, and extend only partially inside along top wall 402 (e.g., along a portion 420), that is, they may not extend along the entire inner surface of top wall 402. Ribs 408 may be positioned relative to rear wall 430 in the same way as described with respect to ribs 108 relative to openings 116 or 118. Similarly, interaction between a sled (e.g., sled 200) and sleeve 400 may be similarly defined as in sleeve 100.

In some embodiments, a hang tab (e.g., hang tab 40 described above with reference to packaging 10) may be included on sleeve 400, or on a sled to be inserted into sleeve 400. In some embodiments, ribs 408 may support the weight of sleeve 400, for example, when a hang tab is affixed to a sled inserted into sleeve 400. As such, a finished packaging may not require any adhesive or other additional closure mechanism other than the ribs 408 to close the packaging. In some embodiments, when hung, ribs 408 may be the only support holding the weight of the sleeve 400 such that it is coupled to the sled.

Figure 11:
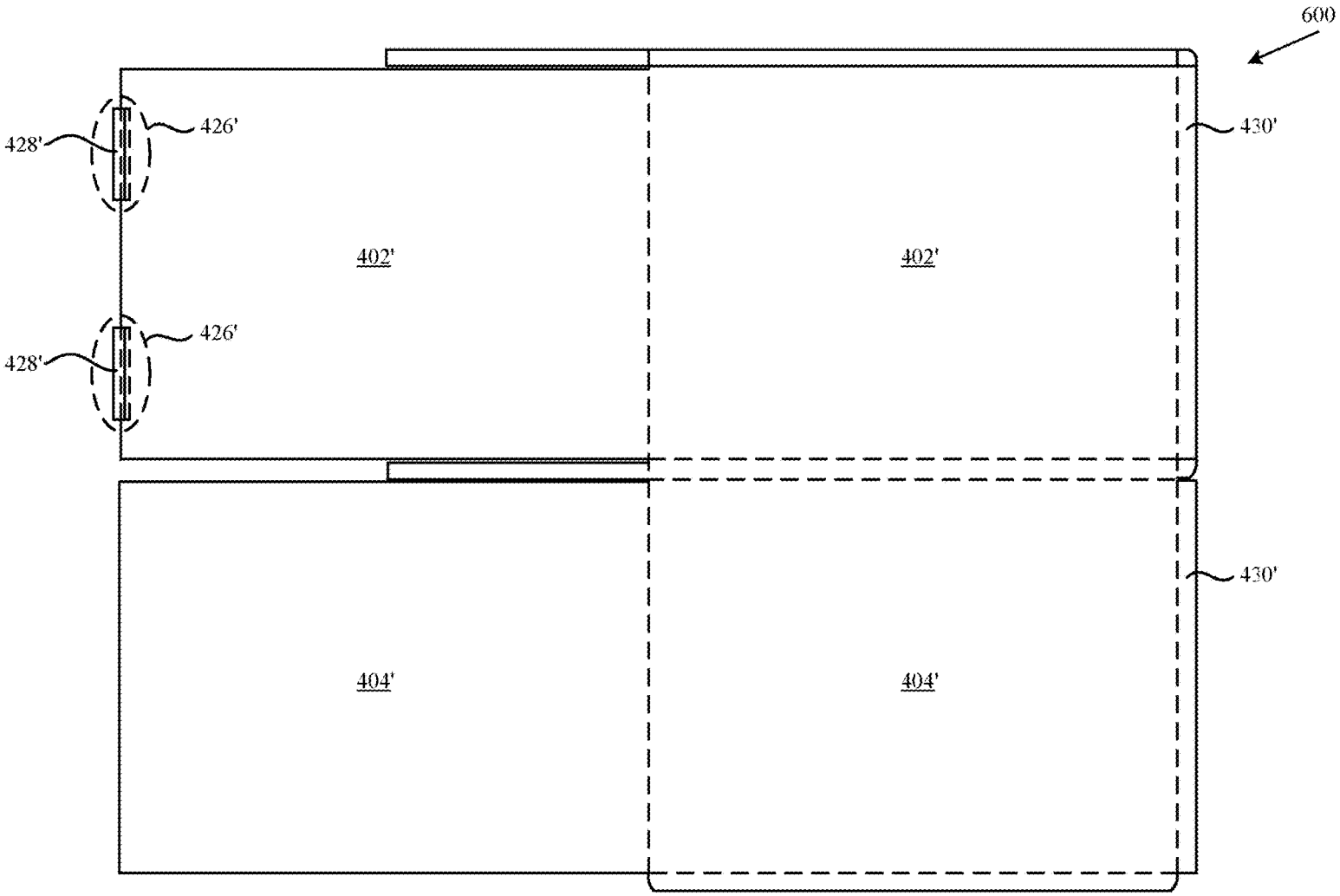
FIG. 11 shows a schematic of an exemplary sleeve blank showing fold lines.

FIG. 11 shows an exemplary schematic of a blank 600 for forming sleeve 400. Blank 600 is formed of a single continuous substrate, such as, for example, paper or a paper-based material like cardboard or paperboard. In some embodiments, surfaces of blank 600 that will form interior surfaces of sleeve 400 may be surface treated or coated, for example with a coating to protect the finished sleeve 400, or product 300. Dotted lines indicate fold lines. Tabs, flaps, and regions without adhesive of blank 600 are folded such that no adhesive is visible in finished sleeve 400. In some embodiments, adhesive may be omitted and the various flaps and tabs attached in another suitable manner. Fold lines may be formed, for example, by weakening the substrate along the lines, such as by perforation, material crushing, scoring, miter cutting, etc., such as is further described below with reference to FIG. 13. As shown, bottom flaps 404' may be folded over top flaps 402', such that they form the top and bottom walls 402 and 404. Blank 600 may include rib-forming region 426', which indicates where ribs 408 will be formed. As shown, rib flap 428' may be folded inward over top flap 402', whereby it is then folded onto itself to create rib 408.

As shown, in FIG. 11, rib-forming region 426' is formed similar to rib region 126, in that the rib is folded inwards towards top wall 402, creating rib 408. As shown, rib flap 428' may be folded over the flap forming top wall 402, whereby it is then folded onto itself to create rib 408. This edge extends towards the center of top wall 402, such that when folded over and adhered together there is no raw edge on the outside of sleeve 400. Additional panels may be folded onto each other to eliminate raw edges on various surfaces of sleeve 400. As shown in FIG. 11, individual blank sections may be folded onto one another, for example to create top wall 402 and bottom wall 404. In some embodiments, sleeve 400 may be constructed with multiple blanks. As shown, rib-forming region 426' may be disposed on one side of blank 600, with the panel 430' forming rear wall 430 disposed on the opposing distal end of blank 600, such that when formed the ribs 408 may be formed without impeding finishing of the sleeve 400.

Figure 12:
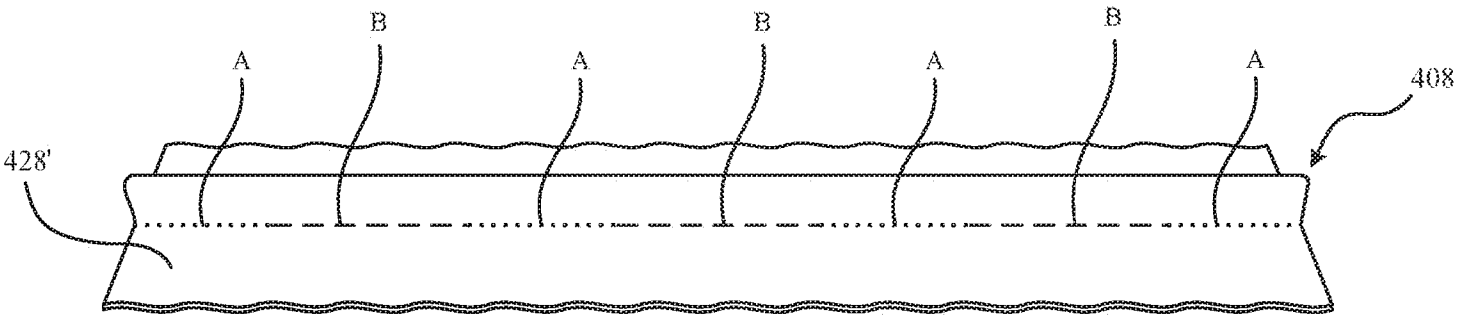
FIG. 12 shows a portion of a rib with fold and cut lines.

Turning to FIG. 12, a detail view of a portion of rib 408 is shown, showing how the rib flap 428' is folded over onto itself, creating rib 408. Additionally, FIG. 12 shows an example crease/cut pattern along the base of the rib. As shown, the base of rib 408 includes an alternating pattern of crease regions A (represented by dotted lines) and cut regions B (represented by dashed lines). In some embodiments, the pattern of regions A and B may be reversed, or repeated in a different manner. The length of crease regions A and cut regions B may be the same, or may be different. In some embodiments, the inner and outer surfaces of the rib may include different proportions of the crease regions and cut regions, such that on either side of rib 408 there may be a different pattern. In some embodiments, the rib region 226 may be pre-folded prior to assembly. In some embodiments, the crease region B length may be longer than a cut region A.

Turning to FIG. 12, a detail view of a portion of rib 408 is shown, showing how the flap 428 is folded over onto itself, creating rib 408. Additionally, FIG. 12 shows an example crease/cut pattern along the base of the rib. As shown, the base of rib 408 includes an alternating pattern of crease regions A (represented by dotted lines) and cut regions B (represented by dashed lines). In some embodiments, the pattern of regions A and B may be reversed, or repeated in a different manner. The length of crease regions A and cut regions B may be the same, or may be different. In some embodiments, the inner and outer surfaces of the rib may include different proportions of the crease regions and cut regions, such that on either side of rib 408 there may be a different pattern. In some embodiments, the rib region 226 may be pre-folded prior to assembly. In some embodiments, the crease region B length may be longer than a cut region A.

Figure 13:
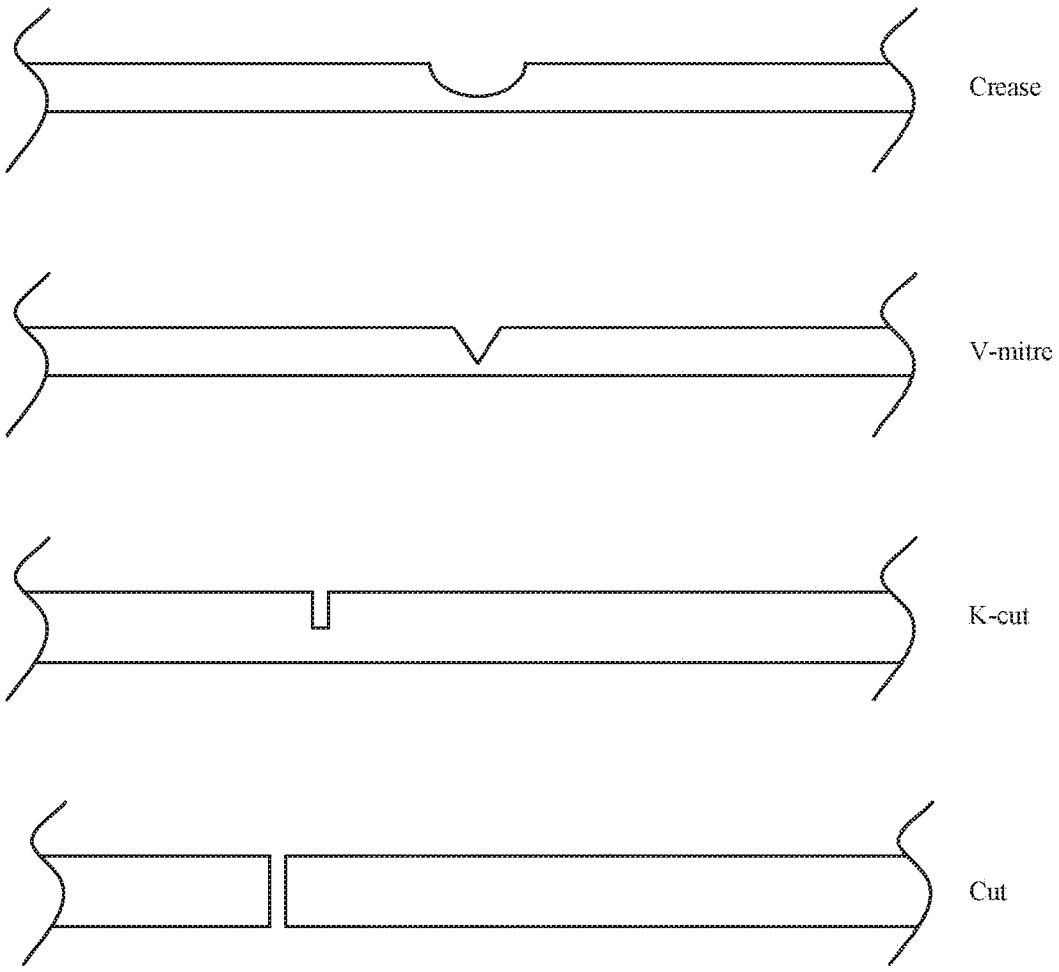
FIG. 13 shows a variety of folding and cutting techniques.

With reference to FIG. 13, schematic representations of different creasing/cutting techniques is shown. At the top of FIG. 13, a crease is shown, where a tool simply deforms a portion of the blank, such that a fold may be achieved. Also shown is a v-mitre, where a tool is used to cut a generally v-shaped groove in the blank by removing material from the blank. Continuing on, a k-cut, or "kiss-cut" is shown, where a tool is used to cut approximately 50% of the way through a blank, without necessarily removing material. Finally, a cut, or full cut is shown, showing how a tool may have cut through the blank. These techniques may be used alone or combined in various patterns together.

As shown in FIGS. 12 and 13, the choice of reasing/cutting techniques, patterns, and dimensions selected may be tailored to tune the force needed to engage ribs 108/408. For example, creases may be stiffer (offer more resistance to deflection) than v-mitres or perforations, which remove material or cut completely through the material, respectively. The stiffness of perforations may be varied by varying the length and spacing of their cuts. The stiffness of v-mitres may be varied by varying the depth of material removed. Additionally, varying the techniques, patterns, and dimensions may also increase durability and reliability, such that the packaging may be opened and closed many times without suffering from fatigue. In this way, the customer experience is positive in that the same experience is repeatable when opening and closing the packaging several times without the feedback indication changing.

Figure 14:
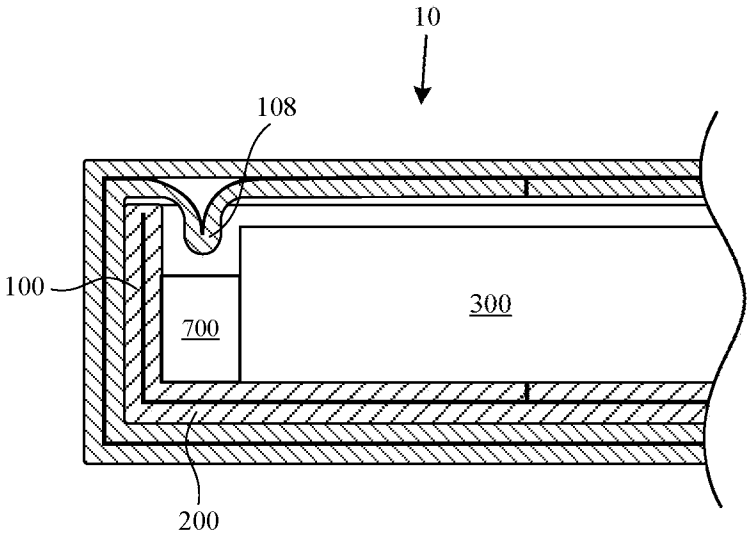
FIG. 14 shows a cut-away schematic illustration of packaging.

Turning to FIG. 14, a variation in packaging 10 is shown, showing spacer 700. In this embodiment, spacer 700 may be disposed such that product 300 is prevented from contacting rib 108 in a generally lateral direction. Simply put, spacer 700 adds distance between the product 300 and rib 108, such that product 300 will never be under rib 108, and when the sled 200 is removed, there is no risk of it contacting product 300. If product 300, for example, is very fragile or prone to scratching, spacer 700 increases packaging robustness and prevents damage to the product.

A finished package 10 may include separate monolithic pieces such as sleeve 100 and sled 200 that are each individually bonded together, using for example, adhesive, tape, or welding.

In some embodiments, any surface finishing may take place after the components are cut from the blank, or alternatively prior to the blank being cut into separate sheets for assembling to a final product. Additionally, some operations may be performed concurrently.

The packaging components may be composed of a recyclable material (e.g., a biodegradable or compostable material). In some embodiments, the packaging components may be composed of a paper, or paper-based product. Suitable paper-based products include, but are not limited to, cardboard or paperboard (e.g., solid bleached sulfate (SBS)). Alternatively or additionally, packaging may be composed of a polymeric material. Suitable polymeric materials include, but are not limited to, polyethylene, polypropylene, polyurethane, polystyrene, polymer blends including one or more of these polymers, or co-polymers including one or more of these polymers. All or some of the surfaces of the packaging may be coated, or laminated, which may increase structural strength properties, such as rigidity and protect a product within the packaging.

Additionally, the packaging may be manufactured in a cost-effective and environmentally friendly way. In some embodiments, the packaging components may be constructed of a single integrally formed piece of material. The single integrally formed piece of material may be a foldable material that is folded into a configuration that holds and secures a product, either alone or within a cavity of a packaging container. In some embodiments, the foldable material may be a single piece of material that is cut by a single operation (e.g., a single die cutting operation). In some embodiments, the foldable material may be die cut from a stock material (e.g., a sheet or roll of material). Single integrally formed pieces of material that are cut by a single cutting operation may facilitate efficient and reproducible manufacturing of cable retainers. Moreover, such manufacturing may reduce waste by reducing waste material during manufacturing.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A packaging, comprising:

a sled configured to receive a product, the sled comprising:

a bottom surface for receiving the product;

first and second sidewalls; and third and fourth sidewalls perpendicular to the first and second sidewalls, wherein the sidewalls of the sled define an open top of the sled; and a sleeve formed from a continuous paper-based substrate, the sleeve comprising:

a top wall;

a bottom wall;

first and second sidewalls, wherein the top wall, the bottom wall, and the sidewalls of the sleeve define a first opening at an end of the sleeve;

a first rib extending downward from the top wall and disposed parallel to an edge of the top wall proximate the first opening, wherein the first rib is configured to engage the first sidewall of the sled when the packaging moves to a closed position, and wherein the first rib is spaced apart from the sidewalls of the sleeve such that the third and fourth sidewalls of the sled may slide between the first rib and the first and second sidewalls of the sleeve;

a second rib extending downward from the top wall and disposed parallel to an edge of the top wall proximate a second opening at an opposing end of the sleeve from the first opening, wherein the second rib is configured to engage the second sidewall of the sled when the packaging moves to the closed position; and wherein, in response to a force sliding the sleeve relative to the sled when the packaging is in the closed position, the first rib is flexed and released by the first sidewall of the sled, wherein the releasing of the first rib produces an indication of opening the packaging, wherein each of the first and second ribs is spaced equidistantly from edges of the first and second openings, respectively, wherein the second rib is spaced apart from the sidewalls of the sleeve such that the third and fourth sidewalls of the sled may slide between the second rib and the first and second sidewalls of the sleeve, and wherein the top wall and the first rib are formed from a continuous substrate such that the first rib extends away from the top wall and is folded back onto itself towards the top wall.

2. A packaging, comprising:

a sled configured to receive a product; and a paper-based sleeve configured to receive the sled through a first or second opening of the sleeve, the sleeve comprising:

a top wall; and a first rib extending downward from the top wall and positioned parallel to an edge of the top wall proximate the first opening, wherein the first rib interferes with and passes over an upper edge of the sled when the packaging moves to a closed position, and wherein the first rib maintains the sled in position relative to the sleeve when the packaging is in the closed position, wherein the top wall and first rib are formed from a continuous paper-based substrate such that the first rib extends away from the top wall and is folded back onto itself towards the top wall, and wherein the sleeve further comprises a second rib extending downward from the top wall and positioned parallel to an edge of the top wall proximate the second opening, wherein the second rib maintains the sled in position relative to the sleeve when the packaging is in the closed position.

3. The packaging of claim 2, wherein the first and second ribs are spaced equidistantly from the edges of the first and second openings, respectively.

4. The packaging of claim 2, wherein one of the sled or sleeve is constructed entirely from paper.

5. The packaging of claim 2, wherein the sleeve is integrally formed from a continuous substrate.

6. The packaging of claim 2, wherein the first rib is spaced apart from a first sidewall.

7. The packaging of claim 2, wherein in response to a force sliding the sleeve relative to the sled, the first rib is deflected and produces audible indication of opening or closing.

8. The packaging of claim 2, wherein the first rib comprises a lower fillet.

9. The packaging of claim 2, wherein the first rib comprises an upper fillet.

10. The packaging of claim 2, wherein the sled further comprises:

a bottom surface for receiving a product;

first and second sidewalls, the first sidewall configured to engage the first rib when the packaging is in the closed position; and third and fourth sidewalls perpendicular to and connecting to the first and second sidewalls, wherein the sled is substantially rigid, and wherein the third and fourth sidewalls are disposed in a space between the first rib and sidewalls of the sleeve.

11. The packaging of claim 2, wherein the sled further comprises a hang tab configured such that a user may pull the hang tab to move the sled from the sleeve from the closed position to an open position.

12. The packaging of claim 2, wherein a lower edge of the first rib is preprocessed in a pattern having alternating creasing and cutting operations along a length of the lower edge.

* * * * *